US011548706B2

(12) United States Patent
Cogliandro

(10) Patent No.: US 11,548,706 B2
(45) Date of Patent: Jan. 10, 2023

(54) ZIP TIE FOR ONE HAND USE

(71) Applicant: John Cogliandro, Dedham, MA (US)

(72) Inventor: John Cogliandro, Dedham, MA (US)

( * ) Notice: Subject to any disclaimer, the term of this patent is extended or adjusted under 35 U.S.C. 154(b) by 56 days.

(21) Appl. No.: 17/163,938

(22) Filed: Feb. 1, 2021

(65) Prior Publication Data

US 2021/0155387 A1 May 27, 2021

Related U.S. Application Data

(62) Division of application No. 15/706,865, filed on Sep. 18, 2017, now Pat. No. 11,161,663.

(51) Int. Cl.
*B65D 63/10* (2006.01)

(52) U.S. Cl.
CPC ..... *B65D 63/1081* (2013.01)

(58) Field of Classification Search
CPC . B65D 63/1081; B65D 63/1054; Y10T 24/14; Y10T 24/1498; Y10T 24/153
See application file for complete search history.

(56) References Cited

U.S. PATENT DOCUMENTS

| | | | |
|---|---|---|---|
| 3,086,265 A | 4/1963 | Orenick | |
| 3,102,311 A | 9/1963 | Martin et al. | |
| 3,837,047 A | 9/1974 | Dennman | |
| 4,008,512 A | 2/1977 | Prodel | |
| 5,181,402 A | 1/1993 | Faessler et al. | |
| 5,457,853 A | 10/1995 | Klein | |
| 5,901,416 A | 5/1999 | Mears | |
| 5,911,368 A | 6/1999 | Davignon | |
| 5,956,813 A | 9/1999 | Cooper | |
| 7,281,302 B2 | 10/2007 | Hewes | |
| 7,513,017 B2 | 4/2009 | Stewart et al. | |
| 7,757,357 B2 | 7/2010 | Stewart et al. | |
| 2005/0204515 A1 | 9/2005 | Hewes | |
| 2005/0241116 A1 | 11/2005 | Stewart et al. | |
| 2009/0151130 A1* | 6/2009 | Stewart | B65D 63/1081 24/16 R |

(Continued)

FOREIGN PATENT DOCUMENTS

GB 994620 A 6/1965

OTHER PUBLICATIONS

Final Office Action dated Apr. 2, 2021 from U.S. Appl. No. 15/706,865, 12 pages.

(Continued)

*Primary Examiner* — Jack W Lavinder
(74) *Attorney, Agent, or Firm* — Daylight Law, P.C.

(57) ABSTRACT

A zip tie operable with one hand comprising a head having a channel defined by a first top wall, a second top wall, a bottom wall, a first side wall, a second sidewall, a front wall and an end wall. The first top wall and the second top wall are configured to cooperate to provide a top access to the channel. Teeth are disposed on an inner wall of the channel transverse to a longitudinal axis of the channel and an elongated member extends from the head. The elongated member has a distal section having a serrated section, a starter cord and a pull tab. The starter cord is insertable into the channel typically through the top access and the pull tag enables pulling of the elongated member through the channel while the one or more teeth engage with the serrated section to prevent the zip tie from getting undone.

20 Claims, 8 Drawing Sheets

(56) References Cited

U.S. PATENT DOCUMENTS

2018/0201421 A1 7/2018 Vorhis

OTHER PUBLICATIONS

Nonfinal Office Action dated Oct. 11, 2019 from U.S. Appl. No. 15/706,865, 10 pages.
Nonfinal Office Action dated Sep. 11, 2020 from U.S. Appl. No. 16/594,022, 7 pages.
Notice of Allowance dated Nov. 13, 2020 from U.S. Appl. No. 16/594,022, 12 pages.
Notice of Allowance dated Jul. 1, 2021 from U.S. Appl. No. 15/706,865, 17 pages.

* cited by examiner

ZIP TIE FOR ONE HAND USE

CROSS-REFERENCE TO RELATED APPLICATION

This application is a divisional patent application of co-pending U.S. patent application Ser. No. 15/706,865 filed Sep. 18, 2017, which is incorporated by reference herein in its entirety for all purposes.

FIELD OF THE INVENTION

The present invention relates generally to ties used to hold together a group of objects. More particularly, the present invention relates to a tie having an improved design which facilitates use of the tie with a single hand.

BACKGROUND OF THE INVENTION

Cable ties or zip ties, also known as tie-wraps are typically plastic fasteners comprising a head (female end) at one end, a tail (male end) at the other end and a longitudinal strap in between. Zip ties are commonly used for securely holding together two or more objects, such as wires or cables or pipes and also for securing a cable or a wire to another object. For use, reference to FIG. 1 the strap of prior art zip tie 100 is wrapped around the bundle of articles and the tail 104 is inserted through an aperture or passage provided in the head 102 to form a closed loop. The head 102 of the cable tie typically includes a locking element which is engageable with the body of the strap so that when the tail 104 is pulled through the head aperture, the locking element secures the strap body in the head and the loop can be tightened as desired. The zip ties are widely used for their convenience in use, reliability and their utility. However, Zip ties (and common sutures, string and rope) suffer from three major drawbacks, often which make them unusable or limit their utility and application.

One disadvantage is the need to visually see the entrance point in the head end of the zip tie where the male end goes into the female end. For some people with excellent dexterity and experience, they may be able to feel this entrance with their fingers with some difficulty and by trial and error.

The need to use two hands to use a zip tie is a second major drawback because often size or space or location limitations do not allow use of two hands. Conventional zip ties require the use of two hands, one hand to hold the female end and one hand to hold the male end and then thread the male end through the female clasp end. The threading is delicate and requires delicate hand motions and good sight lines. Either hand may then align the entrance, both vertically and horizontally and then either hand may insert the male end into the female end by threading the tapered entry point of the male end in and forcing or pulling the strap body of the zip tie through to the desired tension.

Finally, another drawback is the need to pull the free end of the zip tie through the locking mechanism head (female clasp end) to the desired tension. The pulling of one end can be difficult because the zip tie offers no material to obtain a firm grasp with fingers or even with pliers. The small amount of a tapered male end which is provided to facilitate threading the female clasp end more easily is, by its very design, tapered and smooth which make it difficult to grasp. Once the small tapered end is threaded through the female locking mechanism, it is also difficult or impossible to grab the tapered end and pull, especially if the user is in a blind, long reach, one handed situation. In this way zip ties are also very limited in that the locking mechanism is unidirectional, one way, and tension must be applied for them to engage, which also requires securing (holding) the head with one hand and inserting and then pulling the free end with another hand.

While some people with exceptional dexterity and strength in their fingers can, with luck and patience, accomplish this task with one hand on smaller zip ties, it is rare and difficult and limited in practice. In fact, in most cases, zip ties are needed in difficult to reach places, often out of sight and at a long arms length away, such as at the back of an automotive engine compartment or at the end of a surgeon's reach and sight inside a body of a human or animal. Often there is no room to put two hands, even if there is a sight line, or vice versa.

The design of the human body, particularly the head, shoulders, arms and hips, in combination with difficult to reach situations such as under or behind an airplane or automotive or boat dash board is such that one hand can often reach the desired work zone on full extension, but the shoulder and tilt of the head prevent the second hand from reaching the work zone and also prevent the eyes from having a direct line of sight due to the tilt of the head. These situations are frustrating for the worker, who can touch the components that are scheduled to be zip-tied together with one hand but cannot bundle them with the zip-tie due to the inability to wrap, feed and pull the zip tie together without the use of second hand or other method.

Thus, there exists a need for a zip tie design which can overcome the above-mentioned drawbacks of the prior art

OBJECTS OF THE INVENTION

It is, therefore, an object of the present invention to provide a zip tie which can be used with a single hand.

Yet another object of the present invention to provide a zip tie which enables a user to locate and align the male end with the female end for making a loop around a target object even when the location of use lies out of sight of the user.

A further another object of the present invention is to provide a zip tie which has a bulbus end to facilitate capture and pulling taught by the user's fingers instead of the current state of the art which is a narrowed smooth flat end which is difficult to grab and pull.

Another object of the present invention is to provide a zip tie which requires little effort to tighten the loop made by the zip tie, or requires no effort due to a multidirectional insertion at the desired tension without further tensioning around two or more objects on which the zip tie is applied.

Yet another object of the present invention is to provide a zip tie which can be used at locations that are not accessible by both hands of a user together.

Details of the foregoing objects and of the invention, as well as additional objects, features and advantages of the invention will become apparent to those skilled in the art upon consideration of the following detailed description of the preferred embodiments exemplifying the best mode of carrying out the invention as presently perceived.

SUMMARY OF THE INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The present invention is directed to a zip tie which can be used by a user with a single hand and even when the zip tie remains out of sight of the user. The zip tie comprises a clamshell type head having a channel defined by semicircular recesses which are disposed on inside of a first half and a second half of the clamshell type head and an elongated member disposed at one end of the clamshell type head. One or more male locks are disposed on a first half face of the first half and one or more recesses disposed on a second half face of the second half. The channel is configured to receive the elongated member longitudinally and form a loop when the first half and the second half are in open position. The one or more recesses are configured to receive and mate with the one or more male locks when the first half and the second half are closed. It results in locking the channel around the elongated member and preventing loosening of the loop by causing engagement of one or more teeth disposed on recesses inside the channel with a plurality of serrations disposed over said elongated member. A user can then pull the elongated body further to tighten a loop made by the elongated body around one or more objects. In another embodiment the improved zip tie comprises a head with locking halves that optionally require no pulling to facilitate final location.

To the accomplishment of the foregoing and related ends, certain illustrative aspects of the disclosed invention are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

In order to describe the manner in which features and other aspects of the present disclosure can be obtained, a more particular description of certain subject matter will be rendered by reference to specific embodiments that are illustrated in the appended drawings. Understanding that these drawings depict only typical embodiments and are not therefore to be considered to be limiting in scope, nor drawn to scale for all embodiments, various embodiments will be described and explained with additional specificity and detail through the use of the accompanying drawings in which.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as not to obscure the present invention.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
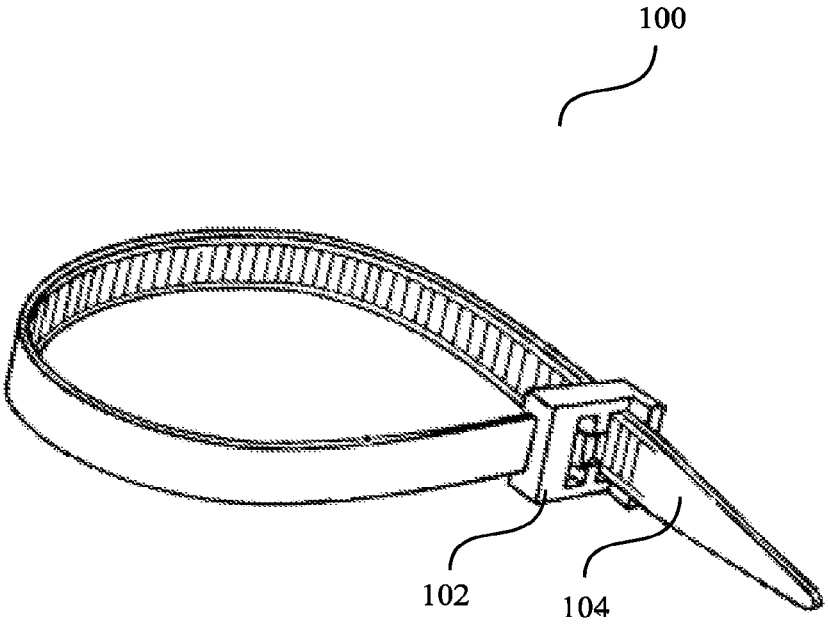
(PRIOR ART) FIG. 1
FIG. 1 illustrates a conventional zip tie design.
Figure 2A:
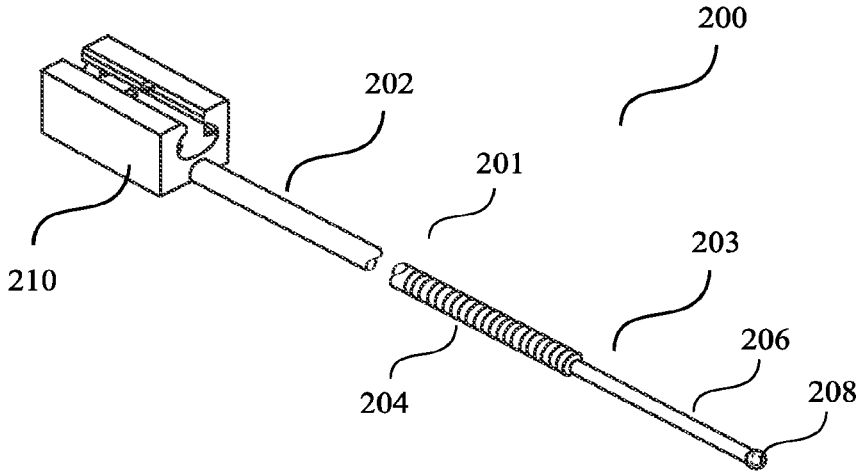
FIG. 2A illustrates a perspective view of a zip tie in accordance with a first embodiment of the present invention.

FIG. 2A illustrates a zip tie 200, hereinafter alternatively referred to as insertable head type zip tie 200, in accordance with a first embodiment of the present invention. The embodiments of the zip tie of the present invention are preferably constructed of a material of sufficient strength and resiliency, such as plastic (nylon or polypropylene etc.). The zip tie 200 comprises a head 210 and an elongated member 201 extending from the head 210.

The elongated member 201 has a generally round cross section body and it can be of any desired length. In prior art zip ties, a generally flat planar shaped strap is used and the male end of the strap requires proper alignment with the female end of the zip tie for making a loop and this task cannot be completed with a single hand of the user. The tip of the male end of prior art is of particularly poor design—smooth and narrowed to facilitate pulling the main strap body through the narrow opening in the head to tighten the strap around the desired materials. This narrowed and smoothed tip design is necessary due to the poor design of the clasp head, and is also simultaneously very difficult for the human hand to grasp and pull. The round cross-section body of the elongated member 201 of the present invention facilitates easy insertion of the elongated member 201 and particularly 206 into the head 210 in a parallel top down motion, called top access, as no specific orientation of the cylindrical body of the elongated member 201 and specifically 206 is needed with respect to the head 210 for insertion. The elongated member 201 comprises a proximal section 202 and a distal section 203. The proximal section 202 may have serrations (204) or it may have a smooth outer surface. The proximal section may be manufactured from a variety of materials including Nylon with a durometer of 60 to 90 hardness. The distal section 203 comprises a main section 204 which may be optionally provided with serrations over it, a free tail 206 and a pull tab or bulb 208. The main section 204, when serrated, possesses a series of transversely spaced peripheral projections which longitudinally extend throughout the serrated section till the start of the free tail 206. The free tail 206 (also referred to as Starter Cord 206 alternatively) has a cross-section substantially smaller than the cross section of the proximal section 202 or main section 204. Also, in a preferred embodiment, the starter cord 206 is made of more flexible material than the material of the rest of the sections of the elongated member 201, such as rubber or nylon with a durometer of 30 to 60 to facilitate one or two fingered manipulation around a bundle of materials with very little effort. The pull tab 208 (also referred to as bulb 208) is disposed at the free end of the starter cord 206 and the pull tab 208 is configured to be graspable by a user's fingers. Dimension-wise the pull tab 208 is bigger in cross-section compared to that of the starter cord 206 so that it can be gripped properly with the fingers of a user's hand unlike the prior art straps of zip tie which are gradually tapered toward the fee end and, thus, does not offer any grip to a user's fingers.

Figure 2B:
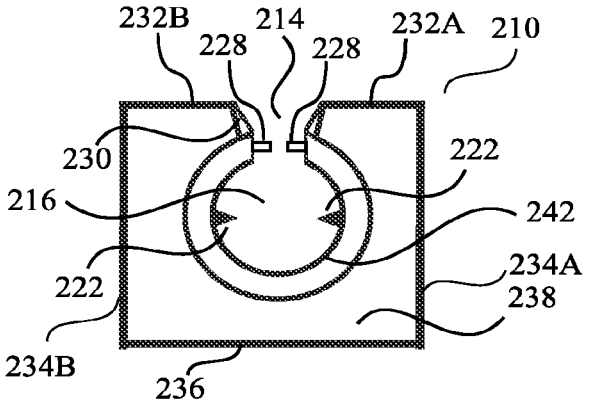
FIG. 2B illustrates an end view of the female end of the zip tie in accordance with the first embodiment of the present invention.
Figure 2C:
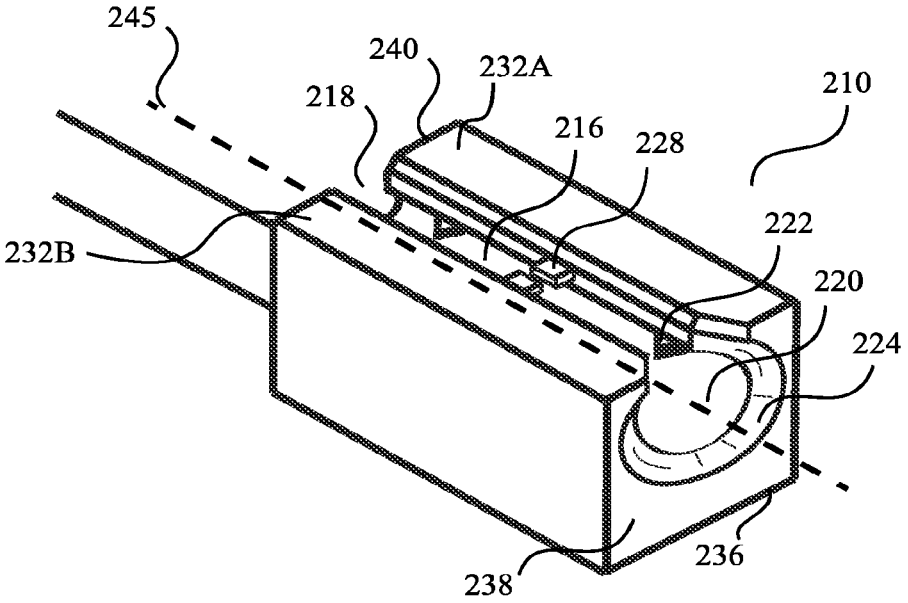
FIG. 2C illustrates a perspective view of the female end of the zip tie in accordance with the first embodiment of the present invention.
Figure 3A:
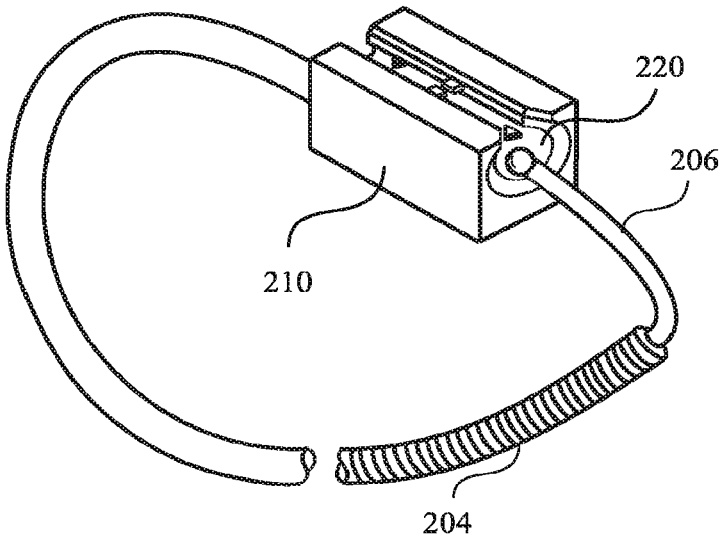
FIG. 3A illustrates a perspective view of the zip tie with male end positioned at the entrance of the female end in accordance with the first embodiment of the present invention.
Figure 3B:
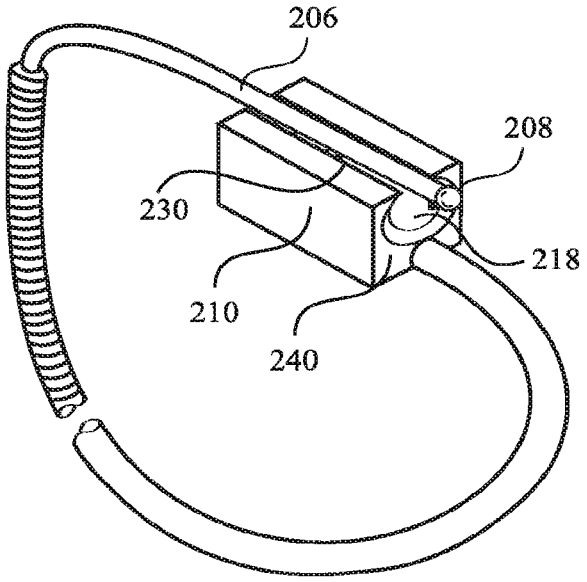
FIG. 3B illustrates a perspective view of the zip tie with male end positioned over the channel of female end in accordance with the first embodiment of the present invention.

The head 210, as illustrated in FIG. 2B and in FIG. 2C, comprises a channel 216. A first top wall 232A and a second top wall 232B, a bottom wall 236, a first side wall 234A and a second sidewall 234B, a front wall 238 and an end wall 240 all cooperate to define the channel 216 which can receive the elongated member 201. The channel 216 extends throughout the head 210 and opens at front wall 238 and at end wall 240. The first top wall 232A and the second top wall 232B cooperate to provide a top access 214 to the channel 216 which extends from the front wall 238 to the end wall 240 throughout the head 210 parallel to the longitudinal axis 245 of the channel 216. In a preferred embodiment, the top access 214 is chamfered from top toward the longitudinal axis 245 of channel 216. The chamfered surfaces 230 disposed on both sides of the top access 214 enable a user to position the starter cord 206 over it easily as shown in FIG. 3B and push down or squeeze with as few as one or two fingers on a single hand in a top down parallel motion or even when it is out of sight of the user as the chamfered surfaces 230 act as guide in positioning the starter cord 206 over them.

Figure 4A:
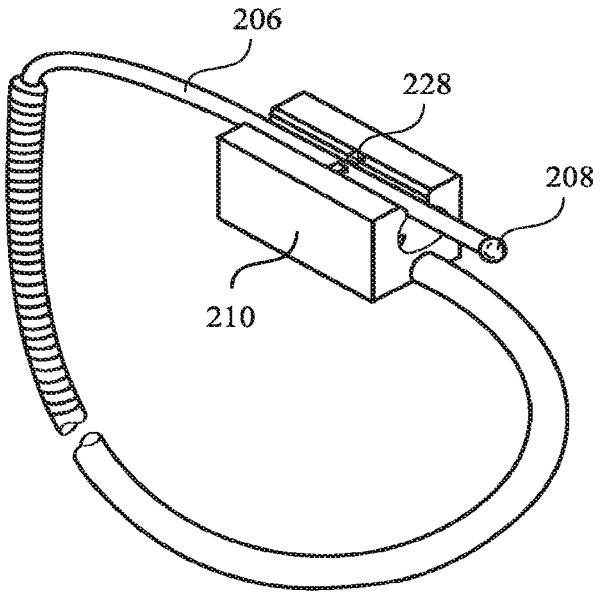
FIG. 4A illustrates a perspective view of the zip tie with male end engaged with the female end in accordance with the first embodiment of the present invention.

On both sides of the top access 214 as shown in FIG. 2B, a plurality of flexible starter cord locking tabs 228 (as shown in FIG. 2B and FIG. 2C) are disposed, preferably in pairs opposite to one another. Once positioned over the top access 214, with a gentle press exerted on the starter cord 206, the user can make the starter cord 206 enter the channel 216 overcoming the resistance offered by the flexible starter cord locking tabs 228. The flexible starter cord locking tabs 228 then do not let the starter cord 206 to slip out through the top access 214 easily as shown in FIG. 4A. In one embodiment for a looped side access, the front wall 238 can be configured to define a front access 220 (as shown in FIG. 2C) on the head

210. Similarly, the end wall 240 (as shown in FIG. 2C) can be configured to define a looped rear access 218 (as shown in FIG. 2C and FIG. 3B). The starter cord 206 can also be taken through the channel 216 after placing the pull tab 208 either on the front access 220 as shown in FIG. 3A or through rear access 218, as required. In a preferred embodiment, the front access 220 and the rear access 218 are chamfered to make the shape of the openings like a funnel with distally increasing diameter toward the outside of the head longitudinally. The dimension of the funnel shaped opening 220 complements the dimension of the pull tab 208 and a user can position the pull tab 208 at the funnel shaped opening 220 even if the funnel shaped opening 220 is not visible to the user. In some embodiments, the rear access 218 to the channel 216 is made similar to the front access 220 in size and shape so that the starter cord 206 can be aligned easily with the head 210 for pushing the starter cord 206 into the channel 216 from either access.

Figure 4B:
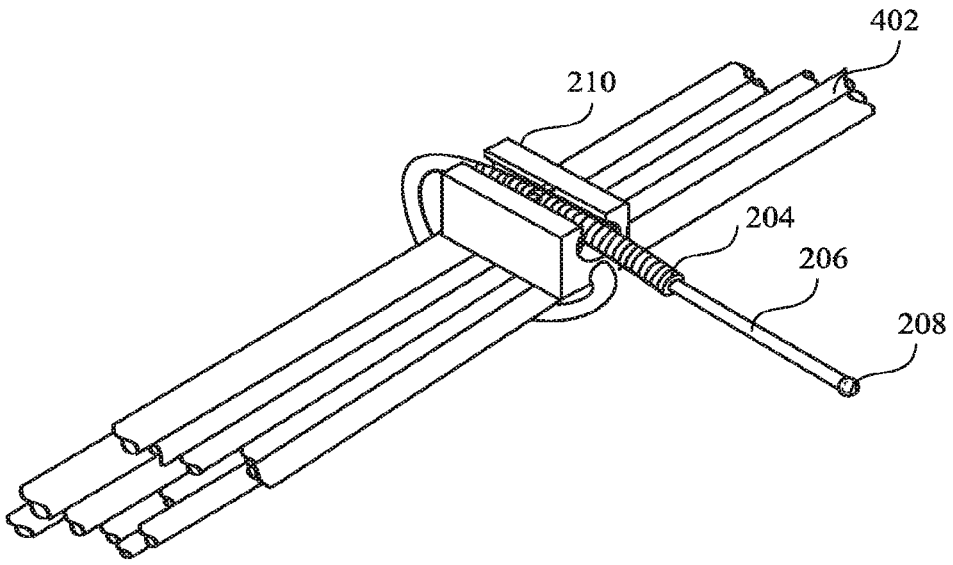
FIG. 4B illustrates a perspective view of the zip tie wrapped around a bundle of objects in accordance with the first embodiment of the present invention.

Inside the channel 216, one or more barbs or teeth or pawls 222 (as shown in FIG. 2B and FIG. 2C) are disposed on the inner wall 242 (as shown in FIG. 2B) transverse to the longitudinal axis 245 of the channel 216. In an alternative embodiment, the teeth are replaced by molded bumps or adhesives. Hereinafter, the barbs, teeth, pawls and the moulded bumps are interchangeably and alternatively referred to as teeth only. The size and shape of the one or more teeth 222 are configured in such a way that they get engaged with the main section 204, or with the transversely spaced peripheral projections of the serrations disposed over said man section 204, once the starter cord 206 is pulled through the channel 216. The pull tab 208 enables the user to pull the elongated member 201 by a single hand. Thus, the one or more teeth 222 prevent the elongated member 201 from getting backed out of the channel 216 (i.e. from getting the zip tie undone) while allowing the elongated member 201 to be pulled forward further as per requirement. FIG. 4B shows the zip tie 200 wrapped around a bundle of objects 402.

Figure 5A:
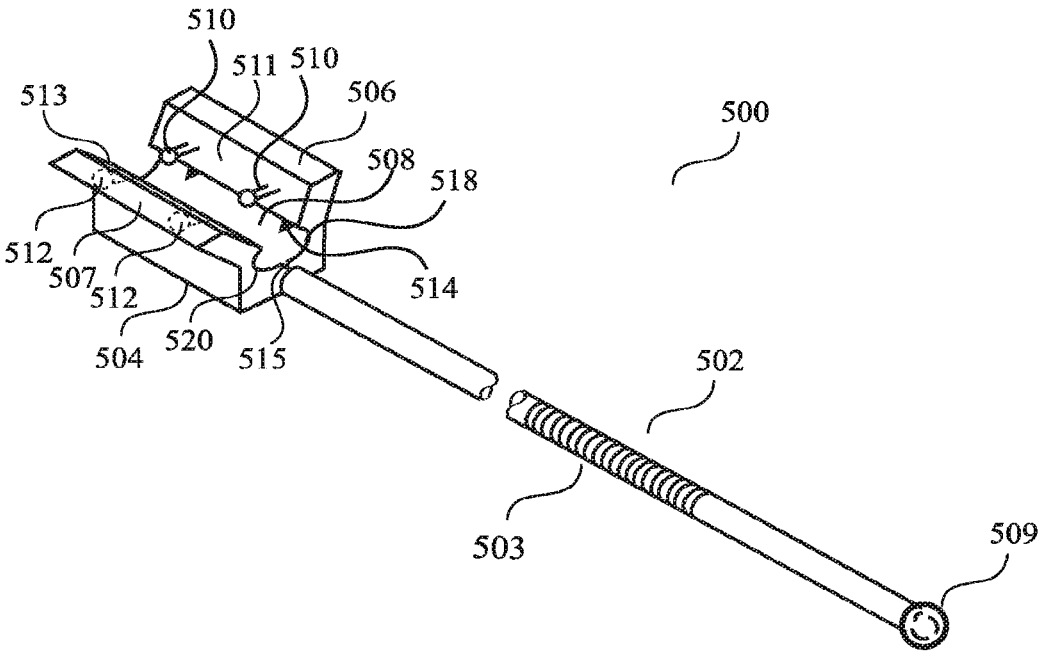
FIG. 5A illustrates a perspective view of a zip tie in accordance with a second embodiment of the present invention.
Figure 5B:
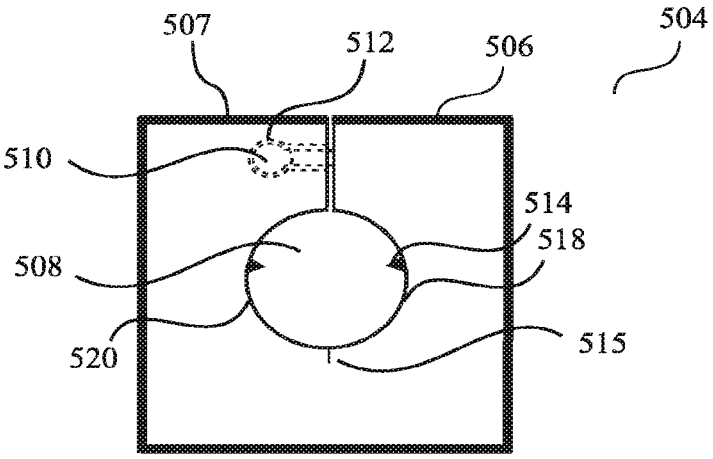
FIG. 5B illustrates an end view of the female end of the zip tie in accordance with the second embodiment of the present invention.

In another embodiment, reference to FIG. 5A and FIG. 5B, the one handed zip tie 500 of the present invention, hereinafter referred to as clamshell head type zip tie 500 alternatively and interchangeably, comprises an elongated member 502 and a clamshell type head 504. The clamshell type head 504 comprises two halves—first half 506 and second half 507, both halves being hinged to each other at hinge point 515 where the first half 506 and the second half 507 abut. The first half 506 is configured to provide a first semicircular recess 518 disposed on inside of first half 506 and the second half 507 is configured to provide a second semicircular recess 520 disposed on inside of second half 507. The first semicircular recess 518 and the second semi circular recess 520 cooperate to define a channel 508 which extends through the clamshell type head 504 with openings at both ends. The channel 508 can receive the elongated member 502 longitudinally and, thus, size and shape of the channel 508 are such that, when both the halves are closed, the channel 508 can hold the elongated member 502 tightly. One or more recesses 512 are disposed on the second half face 513 which receive and mate with the locking surface of one or more male locks 510 disposed on the first half face 511 of the first half 506 when the halves are closed locking the channel 508 into its final desired configuration, preventing slippage of the elongated member 502 from the channel 508 i.e. from getting the zip tie undone. In this embodiment the user has the option of either rear or front looped access or top access with either the body (503) or the starter cord. In an alternative embodiment (not shown in the drawings), the locking mechanism of the male locks (510) and female recesses (512) on the head are replaced by semi-rigid, bendable extensions that can enclose and be wrapped around the clam shell body to hold the halves together. These extensions can be made of flexible metal co-molded with polymer with optional hook & loop fasteners or adhesive or any other suitable method used to retain the bendable extensions around the body in their final locking position providing an even easier locking of the clam shell in blind situations.

The elongated member 502 has a generally round cross section body and it can be of any desired length. In some embodiments, the elongated member 502 comprises a plurality of serrations 503 transversely spaced along the longitude axis of the elongated member 502. Also, optionally, a pull tab 509 configured to be graspable by a user's fingers may be provided at the free end of the elongated member 502.

In some embodiments, one or more barbs or teeth or pawls 514 are disposed on the inner walls of the first semicircular recess 518 and second semicircular recess 520 transverse to the longitudinal axis of the channel 508. The size and shape of the plurality of teeth or barbs 514 are configured in such a way that they get engaged with the plurality of the serrations 503 when the elongated member 502 is inserted in the channel 508 and both the halves of the clamshell type head 504 are closed. Alternatively, the channel can have moulded ramps that interact with the serrations (503) in lieu of or addition to the teeth. The engagement of the teeth 514 with the serrations 503 can ensure that the movement of the elongated member 502 inside the channel 508 is uni-directional only.

Figure 6A:
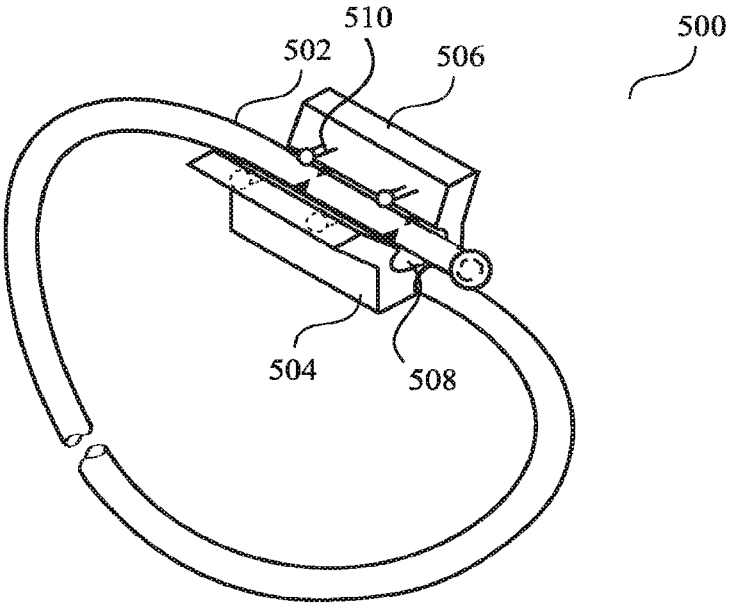
FIG. 6A illustrates a perspective view of the zip tie with male end positioned over the open female end clamp in accordance with the second embodiment of the present invention.
Figure 6B:
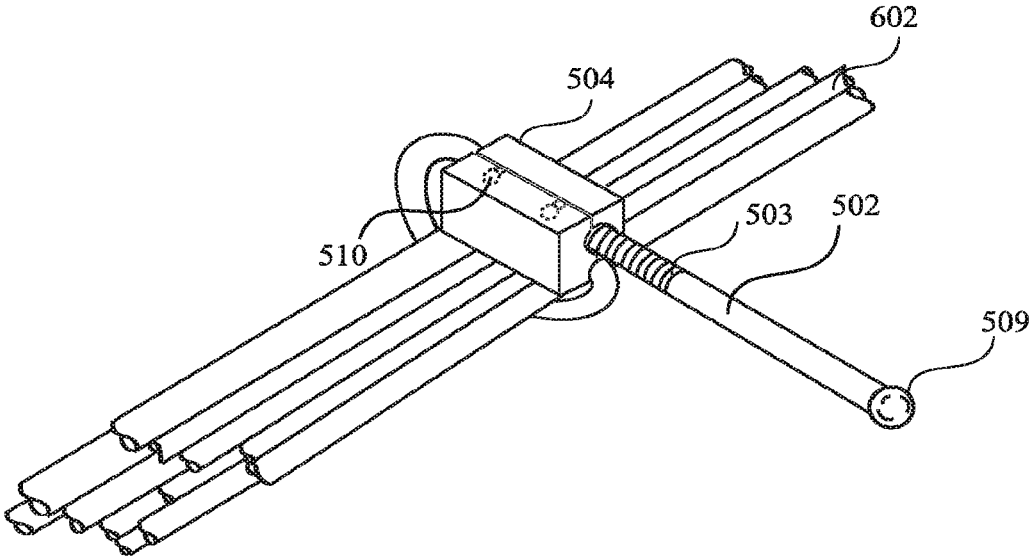
FIG. 6B illustrates a perspective view of the zip tie with male end engaged with the female end in accordance with the second embodiment of the present invention.

For use, the elongated member 502 can be looped around a bundle of objects and one end of the elongated member can then be placed inside the channel 508 as shown in FIG. 6A. The halves of the clamshell type head 504 are then closed together, and, optionally, the elongated member 502 is pulled forward with the help of the pull tab 509 to hold a bundle of objects 602 tightly as shown in FIG. 6B. The design of the clamshell head type zip tie 500 enables a user to have a feel of the clamshell type head 504 by touching it and, since no specific alignment of the elongated member 502 over the open clamshell type head is needed, the user can perform all the steps with a single hand even when the clamshell head type zip tie 500 remains out of sight of the user. The pull tab 509 allows the user to pull the elongated member 502 through the channel 508 to achieve any desired tension around the object over which the clamshell head type zip tie 500 is tied. In some embodiments, the serrations 503 may cooperate with the plurality of one or more teeth or pawls 514 or molded recesses to stop the elongated member 502 from being pulled beyond a certain predetermined pull.

Figure 7A:
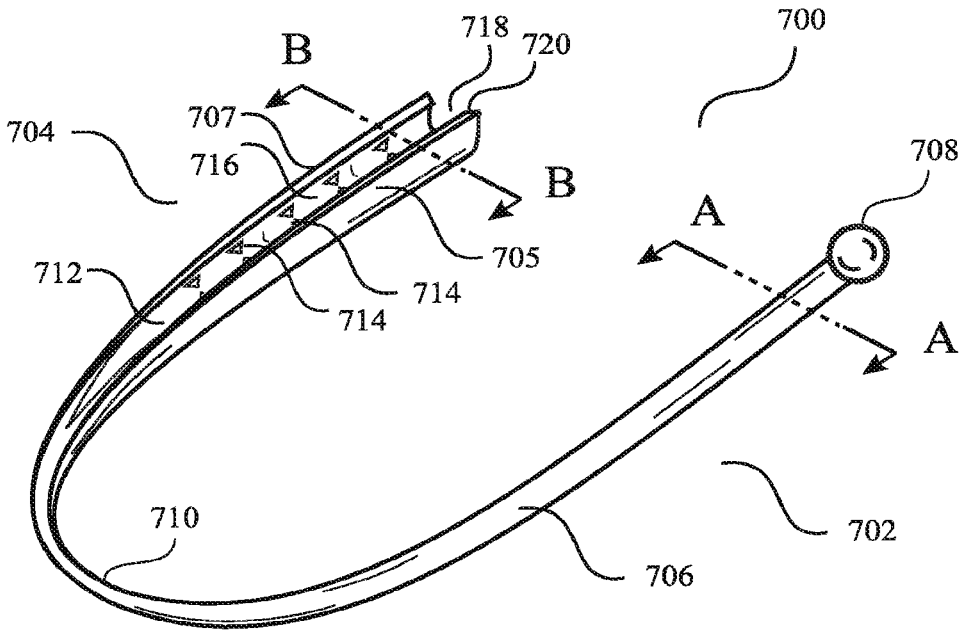
FIG. 7A illustrates a perspective view of a zip tie in accordance with the third embodiment of the present invention.
Figure 7B:
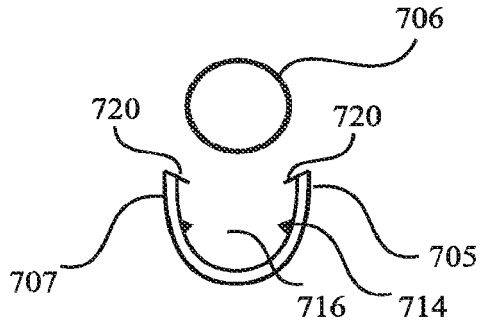
FIG. 7B illustrates a cross-sectional view of both ends of the zip tie across lines A-A and B-B of FIG. 7A in accordance with the third embodiment of the present invention.

In another embodiment, as shown in FIG. 7A, the zip tie of the present invention, hereinafter referred to as U-grip continuous locking body zip tie 700, comprises a male end 702 and a female end 704. The male end 702 comprises a main body 706 which can be of circular cross-section as shown in FIG. 7B across the line A-A of FIG. 7A and a pull tab 708 configured to be graspable by a user's fingers disposed at the free end of the main body 706. In one embodiment, the main body may have serrations over it up to a desired length.

The female end 704 comprises a channel 714 of U-shaped cross section defined by a first wall 705 and a second wall 707. The U-shaped channel 714 can insertably accommodate main body 706 of the male end 702 between the proximal end 712 and distal end 718. The first wall 705 and the second wall 707 originate from the middle section 710 where the main body 706 of male end 702 meets the female end 704. The top surfaces of the walls 705 and 707 protrude inward to form an initial capture clasp 720 which helps preventing the main body 706 from escaping out of the channel 716 through its open end. An optional bump (708) can be molded into the head to add leverage when pulling or placing (702) through.

Figure 8:
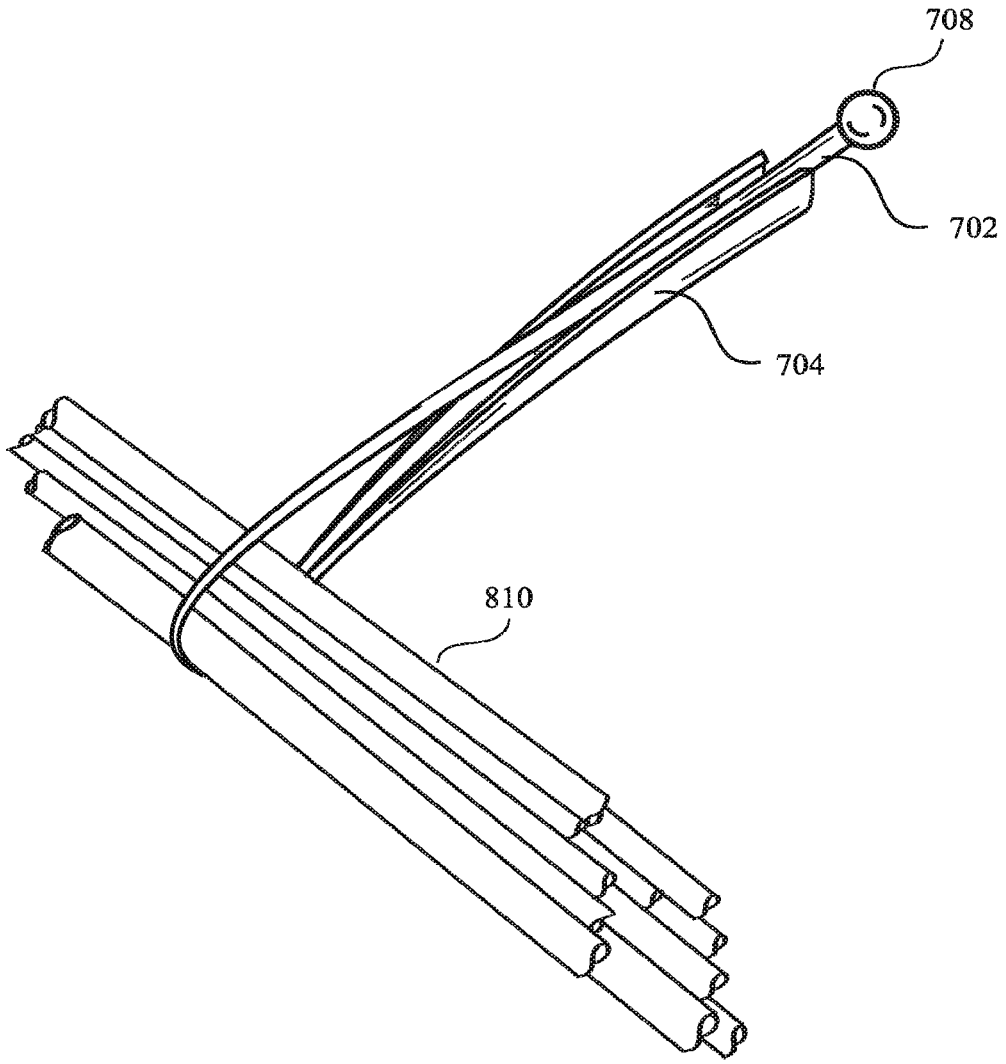
FIG. 8 illustrates a perspective view of the zip tie of the third embodiment wrapped around a bundle of objects.

Inside the channel 716, one or more locking barbs or teeth 714 are disposed transverse to the longitudinal axis of the channel 716 to further locate and lock the main body. The size, shape and rigidity/hardness of one or more teeth 714 are configured in such a way that they can bite into the main body 706 when the main body 706 is inserted into the channel 716 In an alternative embodiment the teeth may be replaced by other locking or friction inducing mechanisms such as a ribbon of adhesive placed on the inner sides or bottom of the channel (716). For use, the zip tie 700 can be looped around a bundle of objects 810 as shown in FIG. 8 or may be looped in other configurations, and the main body 706 of the male end is then inserted into the channel 716 with the pull tab 708 positioned beyond the distal end 718. The pull tab 708 enables the user to place or pull the main body 706 by a single hand to tighten the loop around the bundle of objects 810. Similar to the insertable head zip tie and/or the clam shell head zip tie, the U-Grip tie can be used in a variety of methods including loop-insert-pull-lock and loop-place top down-lock (without pulling).

The use of the terms "a" and "an" and "the" and similar referents in the context of describing the invention are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The terms "affixed", "fitted", "attached", "tied" are to be construed as partly or wholly contained within, attached to, or joined together, even if there is something intervening. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

What is claimed is:

1. A zip tie comprising:

a male end comprising a main body and a starter cord, wherein the starter cord has a cross-section substantially smaller than a cross section of the main body and is made of more flexible material than the main body;

a female end comprising a channel defined by a first wall and a second wall, said channel comprising one or more teeth; and a top surface of said first wall and a top surface of said second wall, said top surface of said first wall and said top surface of said second wall are configured to protrude inward to said channel to form an initial capture clasp; wherein: (i) said channel is configured to insertably accommodate said starter cord of said male end at the initial capture clasp and between a proximal end and a distal end of said female end; (ii) said initial capture clasp has a plurality of flexible starter cord locking tabs that allow the starter cord to enter said channel upon the application of pressure and then do not let the starter cord slip back out; and (iii) once said main body is inside said channel, said initial capture clasp and said one or more teeth prevent said zip tie from getting undone.

2. The zip tie as in claim 1, wherein said main body has a circular cross-section.

3. The zip tie as in claim 1, wherein said male end further comprises a pull tab configured to be graspable by a user's fingers disposed at a free end of said male end.

4. The zip tie as in claim 1, wherein said channel has a U-shaped cross section.

5. A zip tie comprising:

a male end comprising a main body and a starter cord, wherein the starter cord has a cross-section substantially smaller than a cross section of the main body and is made of more flexible material than the main body;

a female end comprising a channel defined by a first wall and a second wall and extending from a distal end to a proximal end;

a top surface of the first wall and a top surface of the second wall, wherein the top surface of the first wall and the top surface of the second wall protrude inward to the channel to form an initial capture clasp;

a locking mechanism; and a friction inducing mechanism;

wherein the initial capture clasp is configured to accommodate the starter cord of the male end between the proximal end and the distal end of the female end;

wherein said locking mechanism is a plurality of flexible starter cord locking tabs that allow the starter cord to enter said channel upon the application of pressure and then do not let the starter cord slip back out; and wherein the locking mechanism and the friction inducing mechanism, when the zip tie is looped, prevent said zip tie from getting undone.

6. The zip tie of claim 5, further comprising:

a middle section which meets the male end and the female end;

wherein the middle section meets the female end at the proximal end; and wherein the first wall and the second wall originate from the middle section.

7. The zip tie of claim 5, wherein:

the locking mechanism comprises one of: (i) a clasp; and (ii) an adhesive.

8. The zip tie of claim 7, wherein:

the initial capture clasp initially maintains the male end in the channel when the male end is placed in the channel; and the locking mechanism is a top-down lock and maintains the male end in the channel when the locking mechanism is engaged.

9. The zip tie of claim 5, wherein:

the locking mechanism is part of the initial capture clasp.

10. The zip tie of claim 5, wherein:

the friction inducing mechanism comprises a first a ribbon of adhesive disposed on the first wall and a second ribbon of adhesive disposed on the second wall.

11. The zip tie of claim 5, wherein:

the friction inducing mechanism comprises a ribbon of adhesive disposed on a bottom surface of the channel.

12. The zip tie of claim 5, wherein:

the friction inducing mechanism comprises a set of teeth continuously disposed in the channel from the distal end to the female end.

13. The zip tie of claim 12, wherein:

the teeth in the set of teeth are configured to bite into the main body of the male end when the zip tie is looped.

14. The zip tie of claim 12, wherein:

the initial capture clasp initially maintains the male end in the channel when the male end is placed in the channel; and the friction inducing mechanism is configured to form a pull lock and maintain the male end in the channel when the male end is pulled to tighten the zip tie.

15. The zip tie of claim 12, wherein:

the initial capture clasp initially maintains the male end in the channel when the male end is placed in the channel;

the locking mechanism is a top-down lock that maintains the male end in the channel when the locking mechanism is engaged; and the friction inducing mechanism maintains the male end in the channel when the locking mechanism is engaged.

16. The zip tie as in claim 5, wherein the main body has a circular cross-section.

17. The zip tie as in claim 5, wherein the male end further comprises a pull tab disposed at a free end of the male end.

18. The zip tie as in claim 5, wherein the channel has a U-shaped cross section.

19. A zip tie comprising:

a male end comprising a main body and a starter cord, wherein the starter cord has a cross-section substantially smaller than a cross section of the main body and is made of more flexible material than the main body;

a female end comprising a channel defined by a first wall and a second wall and extending from a distal end to a proximal end;

a top surface of the first wall and a top surface of the second wall, wherein the top surface of the first wall and the top surface of the second wall protrude inward to the channel to form an initial capture clasp;

a friction inducing mechanism;

wherein the initial capture clasp is configured to accommodate the starter cord of the male end between the proximal end and the distal end of the female end, and has a plurality of flexible starter cord locking tabs that allow the starter cord to enter said channel upon the application of pressure and then do not let the starter cord slip back out;

wherein the friction inducing mechanism is continuously disposed in the channel from the distal end to the proximal end; and whereby the channel forms a continuous locking body.

20. The zip tie of claim 19, wherein:

the friction inducing mechanism comprises teeth; and the teeth are configured to bite into the main body of the male end when the zip tie is looped.

* * * * *